US005894629A

United States Patent [19]

Kim

[11] Patent Number: 5,894,629

[45] Date of Patent: Apr. 20, 1999

[54] SOUND ABSORBING ASSEMBLY FOR A VACUUM CLEANER

[75] Inventor: Suk-Gu Kim, Seoul, Rep. of Korea

[73] Assignee: Daewoo Electronics Co., Ltd., Rep. of Korea

[21] Appl. No.: 08/792,160

[22] Filed: Jan. 30, 1997

[30] Foreign Application Priority Data

May 17, 1996 [KR] Rep. of Korea ..... 1996 16697

[51] Int. Cl.[6] ..... A47L 9/00

[52] U.S. Cl. ..... 15/326; 55/276

[58] Field of Search ..... 15/326; 55/276

[56] References Cited

U.S. PATENT DOCUMENTS

| | | | |
|---|---|---|---|
| 4,829,625 | 5/1989 | Wang . | |
| 4,864,683 | 9/1989 | Herron et al. | 15/326 X |
| 5,293,664 | 3/1994 | Lim et al. | 15/326 |
| 5,454,690 | 10/1995 | Wolfe et al. . | |
| 5,513,417 | 5/1996 | Kim et al. | 15/326 |
| 5,720,074 | 2/1998 | Lee | 15/326 |

FOREIGN PATENT DOCUMENTS

| | | |
|---|---|---|
| 0 622 044 | 11/1994 | European Pat. Off. . |
| 2 114 429 | 8/1993 | United Kingdom . |
| 2 298 572 | 9/1996 | United Kingdom . |
| 94/04065 | 3/1994 | WIPO . |

*Primary Examiner*—Chris K. Moore

*Attorney, Agent, or Firm*—Pillsbury Madison & Sutro, LLP

[57] ABSTRACT

Disclosed is a sound absorbing assembly for a vacuum cleaner, which has a simple internal structure and a low manufacturing cost and is convenient to assemble. A front cap of the sound absorbing assembly supports a front end of a motor assembly and alleviates a vibration which is generated during the operation of the motor assembly. A first taper portion extends radially inwards from an inner end of the front cap. A plurality of engaging protrusions are formed on an outer periphery of the first taper portion. Motor assembly is inserted into the inner end of the front cap at a front end thereof. An air guide encloses a part of a half rear portion of the motor assembly and guides air exhausted from the motor assembly. A rear casing encloses the motor assembly and the air guide. The rear casing is engaged with the inner end of the front cap at an opening end thereof. For this purpose, a second taper portion is formed at an opening end of the rear casing. The second taper portion corresponds to the first taper portion. The rear cap is engaged with a rear end of the motor assembly. The rear cap supports the rear end of the motor assembly and alleviates a vibration which is generated during the operation of the motor assembly.

18 Claims, 6 Drawing Sheets

SOUND ABSORBING ASSEMBLY FOR A VACUUM CLEANER

BACKGROUND OF THE INVENTION

1. Field of the Invention

The present invention relates to a sound absorbing assembly for a vacuum cleaner, and more particularly to a sound absorbing assembly for a vacuum cleaner which has a simple internal structure and a low manufacturing cost and is convenient to assemble.

2. Description of the Prior Art

A variety of vacuum cleaners for easily removing dust or other foreign substances piled up on furniture, a floor, or a carpet in a room have been proposed hitherto. Generally, vacuum cleaners can be classified into canister-type vacuum cleaners and upright-type vacuum cleaners.

A canister-type vacuum cleaner includes a body mounted on wheels and a hose assembly for sucking dust or other foreign substances into the body. A suction generating means such as a suction fan, a motor for driving the suction generating means, and a disposable dust container for filtering dust or other foreign substances from air sucked by the vacuum cleaner, are positioned in the body. A main brush and a suction nozzle are provided at a free end of the hose assembly.

An upright-type vacuum cleaner has a constitution which is similar to that of the canister-type vacuum cleaner. However, the upright-type vacuum cleaner differs in that it vacuums a surface directly beneath its body, so a hose assembly is not required.

These days, the canister-type vacuum cleaner is more frequently used in the home than the upright-type vacuum.

FIG. 5 illustrates a canister-type vacuum cleaner 100. Vacuum cleaner 100 includes a floor cleaning unit 110, a canister unit 120, and a hose assembly 130 extending between floor cleaning unit 110 and canister unit 120.

Floor cleaning unit 110 includes a main brush (not shown) or a suction nozzle (not shown), and the like. Floor cleaning unit 110 is detachably connected to hose assembly 130.

Canister unit 120 mainly includes a hood 122, a cover 124 and a body 126. Hood 122 encloses a dust collecting compartment 140 (refer to FIG. 6) and is pivotally installed onto body 126 so that dust collecting compartment 140 can be opened and closed. Hood 122 is provided with a suction port 127 formed through hood 122 for receiving hose assembly 130. Hood 122 also is provided with a transparent window 128 for notifying the user of the dust collecting state. Cover 124 encloses a motor compartment 150 (referred to FIG. 6) where an electric motor and a suction fan driven by the electric motor are positioned.

Hose assembly 130 comprises a rigid wand 132 and a flexible hose 134. Rigid wand 132 is rotatably connected to flexible hose 134 by a handle assembly 131. Hose assembly 130 is pneumatically connected to a dust collecting compartment 140 of canister unit 120 by a suction hose connector 136.

FIG. 6 schematically illustrates an internal structure of canister unit 120. In body 126 of canister unit 120, dust collecting compartment 140 and motor compartment 150 are formed. That is, a grill portion 160 divides an interior of canister unit 120 into dust collecting compartment 140 and motor compartment 150. A suction opening 162 is formed through a central portion of grill portion 160. Suction opening 162 pneumatically connects dust collecting compartment 140 with motor compartment 150.

In dust collecting compartment 140, a dust container 142 is accommodated. Dust container 142 includes a flat collar 144 made of strawboard and a receptacle portion 146 made of porous paper. Collar 144 is combined with receptacle portion 146 by glue. Dust container 142 is mounted on dust container mounting portion 148 by means of collar 144. At dust container mounting portion 148, dust container 142 is pneumatically connected to hose assembly 130 by a suction hose connector 136 (refer to FIG. 5).

In motor compartment 150, a sound absorbing assembly 170 and an electric cord reel 190 for applying an electric power from an outer electric source to sound absorbing assembly 170 are positioned. Sound absorbing assembly 170 is disposed between grill portion 160 and a fixing rib 164. Fixing rib 164 is formed across motor compartment 150 at a rear portion of motor compartment 150. A plurality of anti-vibration rubber rings 166 are disposed between grill portion 160 and a front end of sound absorbing assembly 170. Anti-vibration rubber rings 166 alleviate a vibration of sound absorbing assembly 170 during the operation of vacuum cleaner 100. Further, anti-vibration rubber rings 166 prevent air, which is introduced from dust collecting compartment 140 through suction opening 162 to motor compartment 150, from leaking around sound absorbing assembly 170. An exhaust port 168 is formed at a rear side of fixing rib 164. Exhaust port 168 is a passageway for air to flow out. That is, exhaust port 168 exhausts the air which is exhausted from sound absorbing assembly 170, to the outside of vacuum cleaner 100.

FIGS. 7A to 7C illustrate sound absorbing assembly 170 of the conventional vacuum cleaner 100 in detail. Sound absorbing assembly 170 includes a front casing 172, a front cap 174, a motor assembly 176, an air guide 178, a rear casing 180 and a rear cap 182. Front casing 172 includes a first suction port 171 which is formed in a central portion of front casing 172. First suction port 171 is a passageway for air to flow into sound absorbing assembly 170. Front casing 172 includes a plurality of first flanges 173 protruding radially outward at an opening end 172*a* of front casing 172. First locking holes 175 are formed in first flanges 173 respectively.

Front cap 174 is disposed between front casing 172 and motor assembly 176. Front cap 174 alleviates a vibration which is generated during the operation of a motor (not shown) installed in motor assembly 176. Front cap 174 includes a second suction port 177 which is formed in a central portion of the front cap 174. Second suction port 177 stands in a row with first suction port 171, which is formed in front casing 172. Second suction port 177 is a passageway for air to flow in.

Motor assembly 176 includes a motor, a suction fan (not shown) which is driven by the motor, and a motor casing for enclosing the motor and the suction fan. The motor is integrally formed with the suction fan. When an electric power is applied from an outer electrical source to motor assembly 176, the motor is operated and drives the suction fan. Then, the suction fan is rotated and generates a vacuum suction force. A third suction port 179 is formed in a central portion of a front end 175*a* of motor casing 175. Third suction port 179 is a passageway for air to flow into motor assembly 176. A plurality of first exhaust ports 176*a* are formed at a rear half portion 175*b* of motor casing 175.

Air guide 178 encloses rear half portion 175*b* of motor casing 175 and guides air which is exhausted from motor assembly 176 through first exhaust ports 176*a*. A first through hole 178*b* (as indicated by dotted line)is formed in a central portion of a rear end 178*a* of air guide 178. First through hole 178*b* receives a rear end 176*b* of motor assembly 176 and rear cap 182 during the assembling of sound absorbing assembly 170.

Rear casing 180 includes a second through hole 181 (as indicated by dotted line) which is formed through a central portion of a closing end 180*a* of rear casing 180. Second through hole 181 receives rear cap 182 during the assembling of sound absorbing assembly 170. A plurality of second exhaust ports 181*a* (as indicated by dotted line) are formed around second through hole 181. Second exhaust ports 181 are passageways for air to flow out. That is, second exhaust ports 181 allows air exhausted from motor assembly 176 into sound absorbing assembly 170 to exhaust to the outside of sound absorbing assembly 170. Rear casing 180 includes a plurality of second flanges 183 protruding radially outward at an opening end 180*b* of rear casing 180. Second flanges 183 correspond to first flanges 173 which are formed at opening end 172*a* of front casing 172. Second locking holes 185 are formed in second flanges 173, respectively. Rear cap 182 is engaged with rear end 176*b* of motor assembly 176 at the time that sound absorbing assembly 170 is assembled. Rear cap 182 is exposed to the outside of sound absorbing assembly 170 through first through hole 178*b* and second through hole 181. Rear cap 182 alleviates a vibration which is generated during the operation of motor assembly 176.

Hereinbelow, an assembling process of sound absorbing assembly 170 of the conventional vacuum cleaner 100 as described above will be briefly described.

First, front cap 174 is fitted onto front end 175*a* of motor assembly 176. Then, rear cap 182 is inserted into first through hole 178*b* of air guide 178, thereby air guide 178 is engaged with rear cap 182. Under this state, air guide 178 is mounted onto motor assembly 176 in order to enclose rear half portion 175*b* of motor assembly 176.

Next, in order to enclose front cap 174, motor assembly 176, and air guide 178, which are engaged together, front casing 172 is engaged with rear casing 180. For this purpose, first locking holes 175, which are formed in first flanges 173 of front casing 172, and second locking holes 183, which are formed in second flanges 183 of rear casing 180, are arranged in a row. Thereafter, a plurality of locking screws 185 are inserted into first locking holes 173 and second locking holes 183 in due sequence. Thereby, the assembling of sound absorbing assembly 170 is completed.

However, in the conventional sound absorbing assembly 170 as described above, in order to engage front casing 172 with rear casing 180, it is necessary to form first flanges 173 and second flanges 183 at an outer periphery of front casing 172 and at an outer periphery of rear casing 180. Further, it is necessary to employ locking screws 186, which are inserted into first locking holes 175 and second locking holes 185.

Accordingly, the manufacturing process and the assembling process of sound absorbing assembly 170 are complicated. Further, working time is largely wasted and the manufacturing cost of sound absorbing assembly 170 is high. In addition, an aperture can be produced at a screw connecting portion due to an incorrect screw connection or due to an elapse of time after the assembling of sound absorbing assembly 170. As a result, an exhaust air can leak through the aperture established between front casing 172 and rear casing 180. Thereby, the noise generated by motor assembly 176 during the operation of motor assembly 176 is increased.

U.S. Pat. No. 4,829,625 issued to Ta C. Wang on May 16, 1989 discloses a portable vacuum cleaner/air compressor having a vacuum casing and an impeller housing for enclosing a motor assembly. In Ta C. Wang's portable vacuum cleaner/air compressor, the motor assembly is disposed between the impeller housing, which encloses a plurality of impellers and the vacuum casing. The impeller housing is forcibly inserted into the vacuum cleaner.

However, in Ta C. Wang's portable vacuum cleaner/air compressor, a plurality of screws for engaging together an air intake cover enclosing the impeller housing, the impellers, the impeller housing and the motor assembly are employed. Accordingly, Ta C. Wang's portable vacuum cleaner/air compressor cannot completely solve the conventional problems as described above.

SUMMARY OF THE INVENTION

The present invention is contrived to solve the foregoing problems. It is an object of the present invention to provide a sound absorbing assembly for a vacuum cleaner which has a simple internal structure and a low manufacturing cost and is convenient to assemble.

In order to achieve the above object, the present invention provides a sound absorbing assembly for a vacuum cleaner, the sound absorbing assembly comprising:

a front cap being exposed to an outside of the sound absorbing assembly at its an outer end, the front cap having a first suction opening for introducing air flowing from a dust collecting compartment of the vacuum cleaner into a motor compartment of the vacuum cleaner, into the sound absorbing assembly, in which the first suction opening is formed through a central portion of the front cap;

a motor assembly including a suction fan for sucking air into the motor assembly by receiving a driving force, a motor for generating the driving force in order to drive the suction fan, a motor casing for enclosing the suction fan and the motor, a second suction opening for introducing air into the motor casing, and a plurality of first exhaust openings for exhausting air from an interior of the motor casing to an outside of the motor casing, in which the second suction opening is formed through a front end of the motor casing, the first exhaust openings are formed at a rear half portion of the motor casing, and the motor assembly is inserted into an inner end of the front cap through the front end of the motor casing;

an air guide for guiding air exhausted through the first exhaust openings from the motor assembly, the air guide enclosing the rear half portion of the motor casing;

a rear casing for enclosing the motor assembly and the air guide in order to protect the motor assembly and the air guide, the rear casing being engaged with the inner end of the front cap at an opening end thereof; and a rear cap for supporting a rear end of the motor assembly and for alleviating a vibration which is generated during the operation of the motor assembly, the rear cap being engaged with the rear end of the motor assembly.

The front cap includes a first taper portion extending radially inwards from the inner end thereof. A plurality of engaging protrusions are formed on an outer periphery of the first taper portion. Preferably, the front cap is made of an anti-vibration rubber by using an injection molding process.

The air guide has a cylindrical shape and includes a first through hole for receiving the rear end of the motor assembly and the rear cap which is engaged with the rear end of the motor assembly. The first through hole is formed through a rear end of the air guide. Preferably, the air guide is made of a plastic by using an injection molding process.

The rear casing includes a second taper portion which is formed at the opening end of the rear casing. The second taper portion corresponds to the first taper portion.

The rear casing has a cylindrical shape and includes a second through hole for receiving the rear cap. The second through hole is formed through a closing end of the rear casing. The rear casing includes a plurality of second exhaust openings for exhausting air which is exhausted from the motor assembly, to the outside of the sound absorbing assembly. The second exhaust openings are formed through a closing end of the rear casing. Preferably, the rear casing is made of a plastic by using an injection molding process.

The rear cap is engaged with the rear end of the motor assembly during the assembling of the sound absorbing assembly, and is exposed to the outside of the sound absorbing assembly through the first through hole and the second through hole. Preferably, the rear cap is made of an anti-vibration rubber by using an injection molding process.

As described above, in the sound absorbing assembly of the vacuum cleaner according to the preferred embodiment of the present invention, the front cap and the rear casing are engaged with each other. Accordingly, it is not necessary to employ the front casing of the conventional sound absorbing assembly. Further, when the sound absorbing assembly is disposed in the motor compartment, the front cap of the sound absorbing assembly supports the sound absorbing assembly and prevents air from leaking by tightly making contact with the grill portion. Accordingly, it is not necessary to employ the anti-vibration rubber rings, which are installed in the conventional vacuum cleaner having the sound absorbing assembly. As a result, the total assembling process of the sound absorbing assembly can be simplified, and the manufacturing cost of the sound absorbing assembly decreases.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Hereinafter, the preferred embodiment of the present invention will be explained in more detail with reference to the accompanying drawings.

Figure 1:
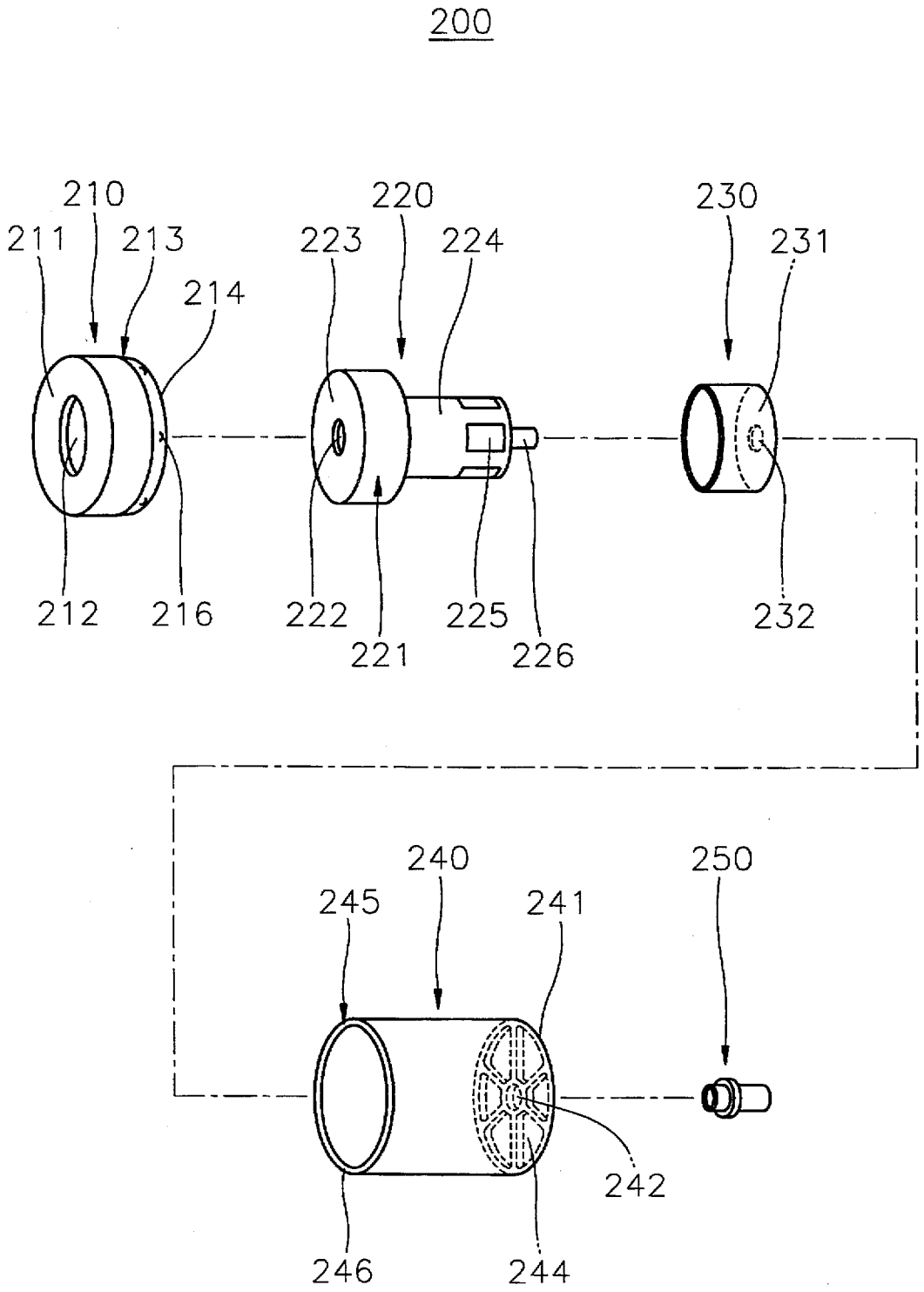
FIG. 1 is an exploded perspective view of a sound absorbing assembly for a vacuum cleaner according to a preferred embodiment of the present invention.
Figure 2:
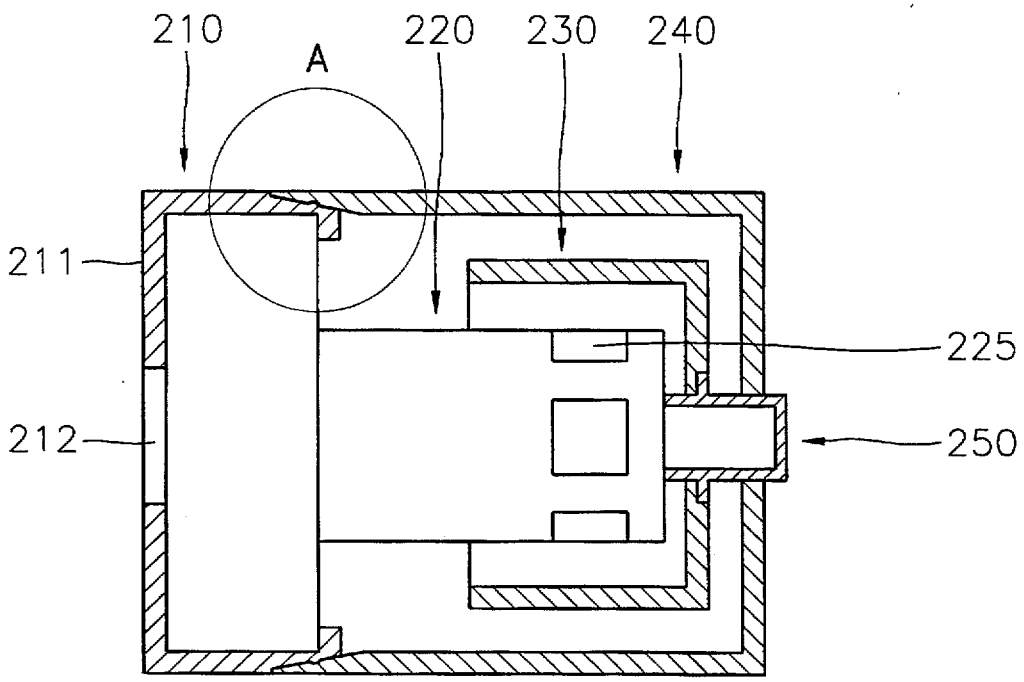
FIG. 2 is a sectional view for showing a combining state of the sound absorbing assembly for the vacuum cleaner illustrated in FIG. 1.

FIGS. 1 and 2 illustrate a sound absorbing assembly 200 for a vacuum cleaner 100*a* according to the present invention. Sound absorbing assembly 200 includes a circular front cap 210, a motor assembly 220, a cylindrical air guide 230, a cylindrical rear casing 240 and a rear cap 250.

Front cap 210 is made of an anti-vibration rubber by using an injection molding process. Front cap 210 alleviates a vibration which is generated during the operation of a motor (not shown) installed in motor assembly 220. Front cap 210 is exposed to an outside of sound absorbing assembly 200 through an outer end 211. Front cap 210 includes a first suction port 212 which is formed through a central portion of front cap 210. First suction port 212 is a passageway for introducing air flowing from dust collecting compartment 140 into motor compartment 150, into sound absorbing assembly 200. Front cap 210 includes a first taper portion 214 radially protruding inward at an inner end 213 of front cap 210. A plurality of engaging protrusions 216 are formed at an outer periphery of first taper portion 214.

Motor assembly 220 includes a motor, a suction fan (not shown) which is driven by the motor, and a motor casing 221 for enclosing the motor and the suction fan. The motor is integrally formed with the suction fan. When an electric power is applied from an outer electrical source to motor assembly 220, the motor of motor assembly 220 is operated and drives the suction fan. Then, the suction fan receives a driving force which is applied from the motor and generates a vacuum suction force.

A second suction port 222 is formed in a central portion of a front end 223 of motor casing 221. Second suction port 222 is a passageway for air to flow in. That is, second suction port 222 allows air to be introduced into motor casing 221 by the suction fan. A plurality of first exhaust ports 225 are formed at a rear half portion 224 of motor casing 221. First exhaust ports 225 are formed in rear half portion 224. First exhaust ports 225 are passageways for exhausting air from an interior of motor casing 221 to an outside of motor casing 221.

Air guide 230 is made of a plastic by using an injection molding process. Preferably, air guide 230 is made of an acrylonitrile-butadiene-styrene resin (hereinbelow, referred to as ABS) by using an injection molding process. Air guide 230 encloses rear half portion 224 of motor assembly 220 and guides air which is exhausted from motor assembly 220 through first exhaust ports 225. A first through hole 232 (as indicated by a dotted line) is formed through a central portion of a rear end 231 of air guide 230. First through hole 232 receives a rear end 226 of motor assembly 220 and rear cap 250 during the assembling of sound absorbing assembly 200.

Rear casing 240 is made of a plastic by using an injection molding process. Preferably, rear casing 240 is made of an ABS resin by using an injection molding process. In order to protect motor assembly 220 and air guide 230, rear casing 240 encloses motor assembly 220 and air guide 230. Rear casing 240 includes a second through hole 242 (as indicated by dotted lines) which is formed through a central portion of a closing end 241 of rear casing 240. Second through hole 242 receives rear cap 250 during the assembling of sound absorbing assembly 200.

A plurality of second exhaust ports 244 (as indicated by dotted line) are formed around second through hole 242. Second exhaust ports 244 are passageways for air to flow out. That is, second exhaust ports 244 allows air exhausted from motor assembly 220 into sound absorbing assembly 200, to exhaust to the outside of sound absorbing assembly 200. Rear casing 240 includes a second taper portion 246 which is formed at an opening end 245 of rear casing 240. Second taper portion 246 protrudes radially inwards. Second taper portion 246 corresponds to first taper portion 214, which is formed at inner end 213 of front cap 210.

Rear cap 250 is made of a rubber by using an injection molding process. Rear cap 250 engages with rear end 226 of motor assembly 220 at the time when sound absorbing assembly 200 is assembled. Rear cap 250 is exposed to the outside of sound absorbing assembly 200 through first through hole 232 and second through hole 242. Rear cap 250 supports rear end 226 of motor assembly 220 and alleviates a vibration which is generated during the operation of motor assembly 220.

Hereinbelow, an assembling process of sound absorbing assembly 200 of the conventional vacuum cleaner 100*a* described above will be briefly described. Referring to FIG. 1 and 2, front end 223 of motor assembly 220 is inserted into inner end 213 of front cap 210, thereby front cap 210 and motor assembly 220 are engaged with each other. Then, rear cap 250 is inserted into first through hole 232 of air guide 230, thereby air guide 230 and rear cap 250 are engaged with each other. Under this state, air guide 230 is mounted onto motor assembly 220 in order to enclose rear half portion 224 of motor assembly 220. At this time, rear end 226 of motor assembly 220 is inserted into rear cap 250 protruding toward motor assembly 220 through first through hole 232. Thereafter, in order to enclose motor assembly 220 and air guide 230, which are engaged with each other, rear casing 240 is engaged with front cap 210.

Figure 3:
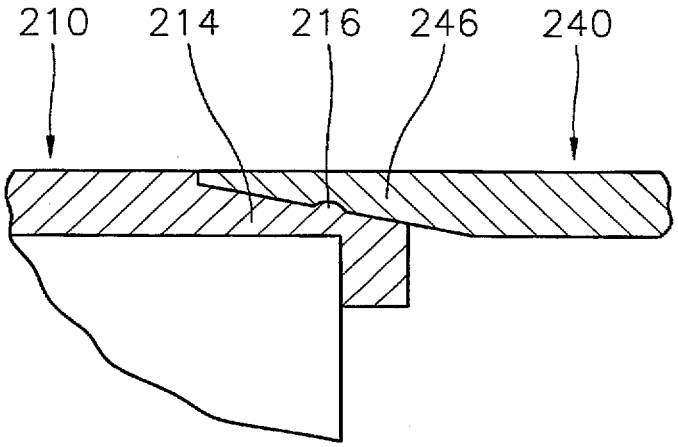
FIG. 3 is an enlarged view of a III portion illustrated in FIG. 2.

FIG. 3 illustrates a combining portion of front cap 210 and rear casing 240 in detail. As shown in FIG. 3, front cap 210 and rear casing 240 are engaged with each other by inserting the elastic first taper portion 214 of front cap 210 into second taper portion 246 of rear casing 240. At this time, due to the pressing force relating to inserting front cap 210 into rear casing 240 and due to an elastic force of front cap 210, engaging protrusion 216, which is formed at the outer periphery of first taper portion 214, tightly makes contact with second taper portion 246 of rear casing 240. Thereby, front cap 210 and rear casing 240 are firmly engaged with each other.

Figure 4:
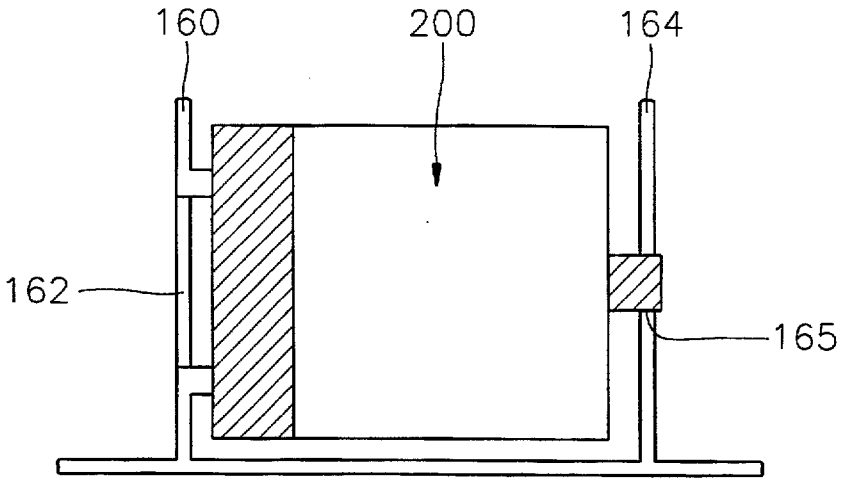
FIG. 4 illustrates an installing state of the sound absorbing assembly for the vacuum cleaner in a motor compartment.
Figure 5:
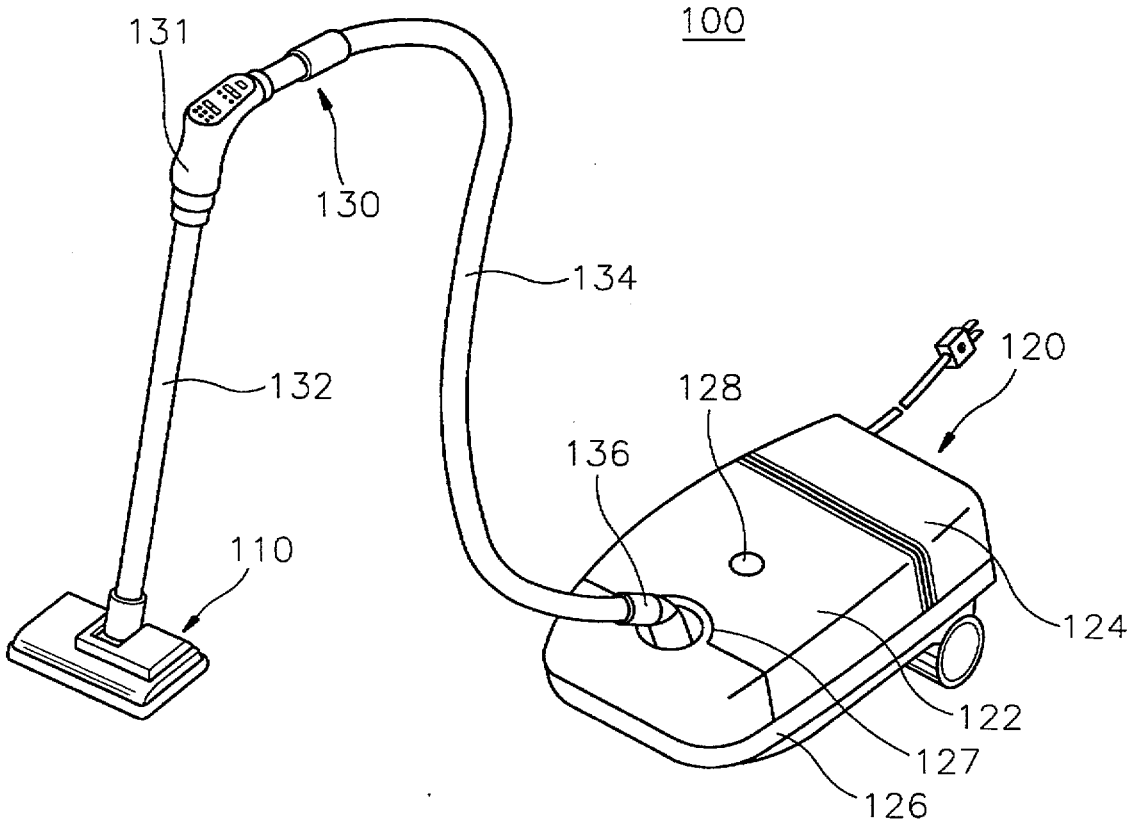
FIG. 5 (PRIOR ART)
FIG. 5 is a perspective view of a canister-type vacuum cleaner according to the prior art.
Figure 6:
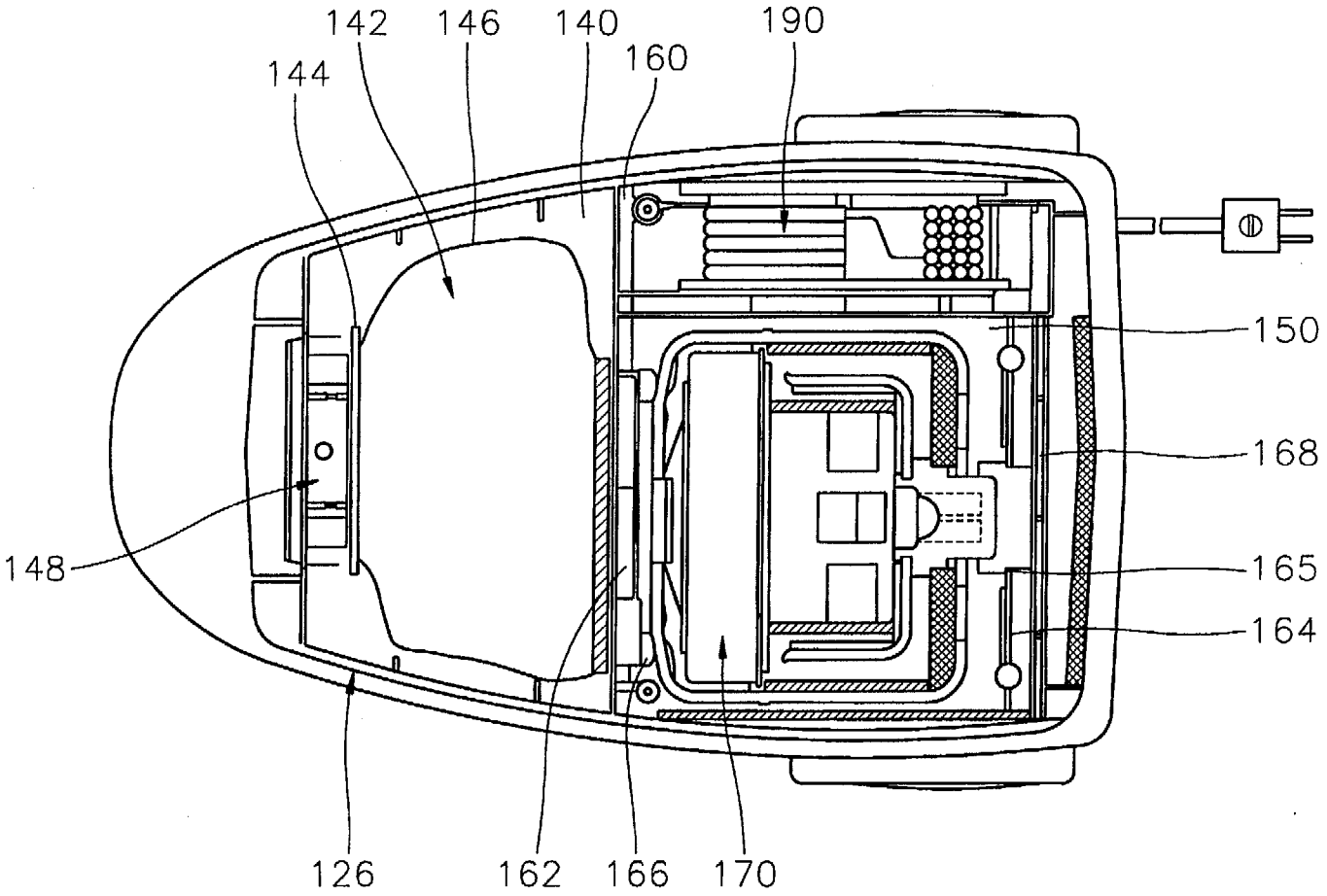
FIG. 6 (PRIOR ART)
FIG. 6 is a longitudinal sectional view of a canister unit illustrated in FIG. 5.
Figure 7A:
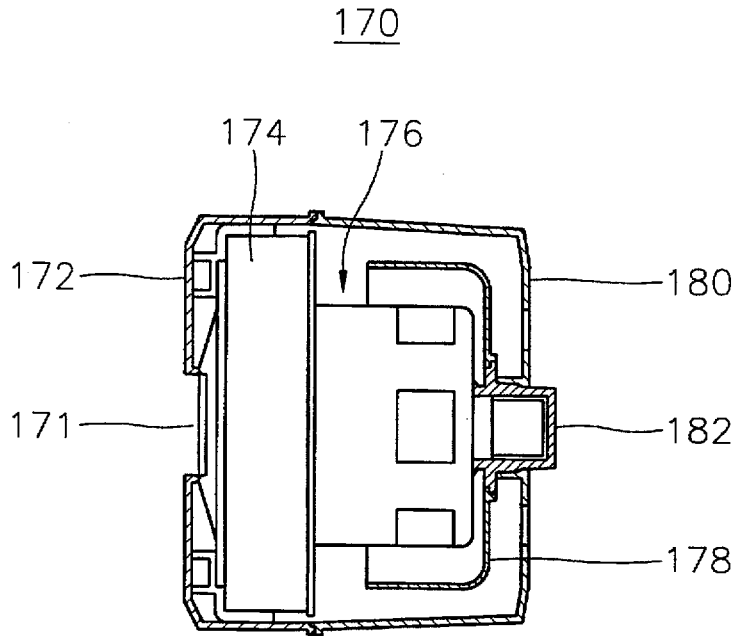
FIG. 7A (PRIOR ART)
FIG. 7A is an enlarged view of a sound absorbing assembly for the vacuum cleaner illustrated in FIG. 6.
Figure 7B:
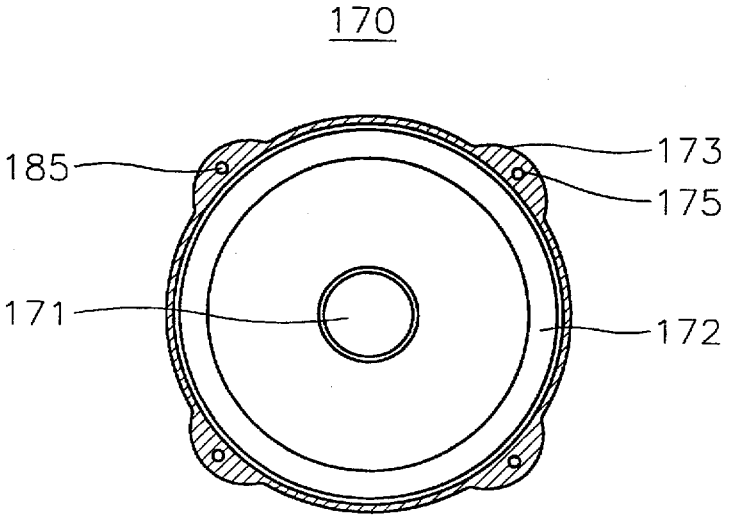
FIG. 7B (PRIOR ART)
FIG. 7B is a front view of the sound absorbing assembly for the vacuum cleaner illustrated in FIG. 7A.
Figure 7C:
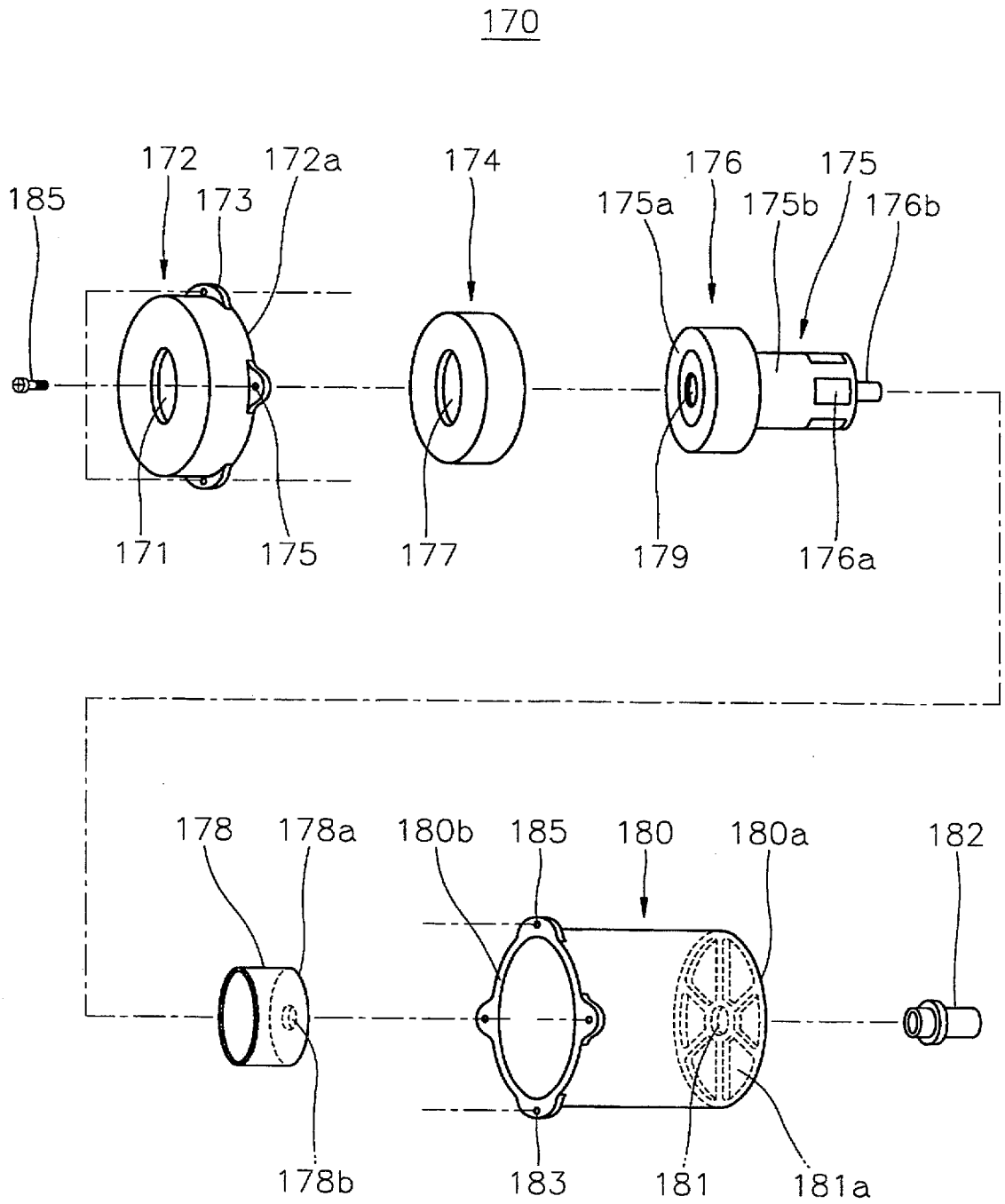
FIG. 7C (PRIOR ART)
FIG. 7C is an exploded perspective view of the sound absorbing assembly for the vacuum cleaner illustrated in FIG. 7A.

Sound absorbing assembly 200 as described above is disposed in motor compartment 150 of vacuum cleaner 100*a*. FIG. 4 illustrates an installing state where sound absorbing assembly 200 according to the present invention is disposed in motor compartment 150 of vacuum cleaner 100*a*. An inner constitution of vacuum cleaner 100*a* is the same as that of the conventional vacuum cleaner 100 which had described with reference to FIG. 6, except for sound absorbing assembly 200 according to the present invention. Accordingly, descriptions of constitutional elements which are identical to the constitutional elements of the conventional vacuum cleaner 100 will be omitted. Further, inventive elements which are identical to the inventive elements used in the prior art have the same reference numerals.

Referring to FIG.4, sound absorbing assembly 200 is disposed between grill portion 160 and fixing rib 164. Front cap 210 of sound absorbing assembly 200 tightly makes contact with grill portion 160. Thereby, front cap 210 alleviates a vibration which is generated during the operation of the motor. Further, front cap 210 prevents air introduced from dust collecting compartment 140 through suction port 162 into motor compartment 150, from leaking around sound absorbing assembly 200.

Rear cap 250 of sound absorbing assembly 200 is inserted into a fixing groove 165 of fixing rib 164, which is formed across motor compartment 150 at a rear side of motor compartment 150. Thereby, rear cap 250 supports sound absorbing assembly 200 and alleviates a vibration which is generated during the operation of the motor.

As described above, in the sound absorbing assembly 200 of vacuum cleaner 100*a* according to the preferred embodiment of the present invention, front cap 210 and rear casing 240 are engaged with each other. Accordingly, it is not necessary to employ front casing 172 of the conventional sound absorbing assembly 170. Further, when sound absorbing assembly 200 is disposed in motor compartment 150, front cap 210 of sound absorbing assembly 200 supports sound absorbing assembly 200 and prevents air from leaking by tightly making contact with grill portion 160. Accordingly, it is not necessary to employ anti-vibration rubber rings 166, which are installed in the conventional vacuum cleaner 100 having sound absorbing assembly 170. As a result, the total assembling process of sound absorbing assembly 200 can be simplified, and the manufacturing cost of sound absorbing assembly 200 decreases.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A sound absorbing assembly for a vacuum cleaner, said absorbing assembly comprising:

a front cap being exposed to an outside of the sound absorbing assembly at its outer end, said front cap having a first suction opening for introducing air flowing from a dust collecting compartment of the vacuum cleaner into a motor compartment of the vacuum cleaner, into said sound absorbing assembly, in which said first suction opening is formed through a central portion of said front cap, said front cap including a first taper portion extending radially inwards from an inner end thereof;

a motor assembly including a suction fan for sucking air into said motor assembly by receiving a driving force, a motor for generating the driving force in order to drive said suction fan, a motor casing for enclosing said suction fan and said motor, a second suction opening for introducing air into said motor casing, and a plurality of first exhaust openings for exhausting air from an interior of said motor casing to an outside of said motor casing, in which said second suction opening is formed through a front end of said motor casing, said first exhaust openings are formed at a rear half portion of said motor casing, and said motor assembly is inserted into an inner end of said front cap through the front end of said motor casing;

an air guide for guiding air exhausted through said first exhaust openings from said motor assembly, said air guide enclosing the rear half portion of said motor casing;

a rear casing for enclosing said motor assembly and said air guide in order to protect said motor assembly and said air guide, said rear casing being engaged with the inner end of said front cap at an opening end thereof; and a rear cap for supporting a rear end of said motor assembly and for alleviating a vibration which is generated during the operation of said motor assembly, said rear cap being engaged with the rear end of said motor assembly.

2. A sound absorbing assembly for a vacuum cleaner as claimed in claim 1, wherein a plurality of engaging protrusions are formed on an outer periphery of said first taper portion.

3. A sound absorbing assembly for a vacuum cleaner as claimed in claim 1, wherein said front cap is made of an anti-vibration rubber by using an injection molding process.

4. A sound absorbing assembly for a vacuum cleaner as claimed in claim 1, wherein said air guide has a cylindrical shape and includes a first through hole for receiving the rear end of said motor assembly and said rear cap which is engaged with the rear end of said motor assembly, said first through hole being formed through a rear end of said air guide.

5. A sound absorbing assembly for a vacuum cleaner as claimed in claim 1, wherein said air guide is made of a plastic by using an injection molding process.

6. A sound absorbing assembly for a vacuum cleaner as claimed in claim 1, wherein said rear casing includes a second taper portion which is formed at the opening end of said rear casing, and said second taper portion corresponding to said first taper portion.

7. A sound absorbing assembly for a vacuum cleaner as claimed in claim 1, wherein said rear casing has a cylindrical shape and includes a second through hole for receiving said rear cap, said second through hole being formed through a closing end of said rear casing.

8. A sound absorbing assembly for a vacuum cleaner as claimed in claim 1, wherein said rear casing includes a plurality of second exhaust openings for exhausting air which is exhausted from said motor assembly, to the outside of said sound absorbing assembly, said second exhaust openings being formed through a closing end of said rear casing.

9. A sound absorbing assembly for a vacuum cleaner as claimed in claim 1, wherein said rear casing is made of a plastic by using an injection molding process.

10. A sound absorbing assembly for a vacuum cleaner as claimed in claim 1, wherein said rear cap is engaged with the rear end of said motor assembly during the assembling of said sound absorbing assembly, and is exposed to the outside of said sound absorbing assembly.

11. A sound absorbing assembly for a vacuum cleaner as claimed in claim 1, wherein said rear cap is made of an anti-vibration rubber by using an injection molding process.

12. A sound absorbing assembly for a vacuum cleaner, said sound absorbing assembly comprising:

a front cap being exposed to an outside of the sound absorbing assembly at its outer end, said front cap being made of an anti-vibration rubber by using an injection molding process, said front cap having a first suction opening for introducing air flowing from a dust collecting compartment of the vacuum cleaner into a motor compartment of the vacuum cleaner, into said sound absorbing assembly, said front cap including a first taper portion extending radially inwards from the inner end thereof, in which said first suction opening is formed through a central portion of said front cap;

a motor assembly including a suction fan for sucking air into said motor assembly by receiving a driving force, a motor for generating the driving force in order to drive said suction fan, a motor casing for enclosing said suction fan and said motor, a second suction opening for introducing air into said motor casing, and a plurality of first exhaust openings for exhausting air from an interior of said motor casing to an outside of said motor casing, in which said second suction opening is formed through a front end of said motor casing, said first exhaust openings are formed at a rear half portion of said motor casing, and said motor assembly is inserted into an inner end of said front cap through the front end of said motor casing;

an air guide for guiding air exhausted through said first exhaust openings from said motor assembly, said air guide being made of a plastic by using an injection molding process, and said air guide enclosing the rear half portion of said motor casing;

a rear casing for enclosing said motor assembly and said air guide in order to protect said motor assembly and said air guide, said rear casing being made of a plastic by using an injection molding process, said rear casing being engaged with the inner end of said front cap at an opening end thereof, said rear casing including a second taper portion which is formed at the opening end of said rear casing, in which said second taper portion corresponds to said first taper portion; and a rear cap for supporting a rear end of said motor assembly and for alleviating a vibration which is generated during the operation of said motor assembly, said rear cap being made of an anti-vibration rubber by using an injection molding process, and said rear cap being engaged with the rear end of said motor assembly.

13. A sound absorbing assembly for a vacuum cleaner as claimed in claim 12, wherein a plurality of engaging protrusions are formed on an outer periphery of said first taper portion.

14. A sound absorbing assembly for a vacuum cleaner as claimed in claim 12, wherein said air guide has a cylindrical shape and includes a first through hole for receiving the rear end of said motor assembly and said rear cap which is engaged with the rear end of said motor assembly, said first through hole being formed through a rear end of said air guide.

15. A sound absorbing assembly for a vacuum cleaner as claimed in claim 12, wherein said rear casing has a cylindrical shape and includes a second through hole for receiving said rear cap, said second through hole being formed through a closing end of said rear casing.

16. A sound absorbing assembly for a vacuum cleaner as claimed in claim 12, wherein said rear casing includes a plurality of second exhaust openings for exhausting air which is exhausted from said motor assembly, to the outside of said sound absorbing assembly, said second exhaust openings being formed through a closing end of said rear casing.

17. A sound absorbing assembly for a vacuum cleaner as claimed in claim 12, wherein said rear cap is engaged with the rear end of said motor assembly during the assembling of said sound absorbing assembly, and is exposed to the outside of said sound absorbing assembly through said first through hole and said second through hole.

18. A sound absorbing assembly for a vacuum cleaner, said sound absorbing assembly comprising:

(a) a front cap being exposed to an outside of the sound absorbing assembly at its outer end, said front cap being made of an anti-vibration rubber by using an injection molding process, said front cap having a first suction opening for introducing air flowing from a dust collecting compartment of the vacuum cleaner into a motor compartment of the vacuum cleaner, into said sound absorbing assembly, said front cap including a first taper portion extending radially inwards from the inner end thereof, in which said first suction opening is formed through a central portion of said front cap, and a plurality of engaging protrusions are formed on an outer periphery of said first taper portion;

(b) a motor assembly including a suction fan for sucking air into said motor assembly by receiving a driving force, a motor for generating the driving force in order to drive said suction fan, a motor casing for enclosing said suction fan and said motor, a second suction opening for introducing air into said motor casing, and a plurality of first exhaust openings for exhausting air from an interior of said motor casing to an outside of said motor casing, in which said second suction opening is formed through a front end of said motor casing, said first exhaust openings are formed at a rear half portion of said motor casing, and said motor assembly is inserted into an inner end of said front cap through the front end of said motor casing;

(c) an air guide for guiding air exhausted through said first exhaust openings from said motor assembly, said air guide being made of a plastic by using an injection molding process, said air guide enclosing the rear half portion of said motor casing, and said air guide having a cylindrical shape and including a first through hole for receiving the rear end of said motor assembly, in which said first through hole is formed through a rear end of said air guide;

(d) a rear casing for enclosing said motor assembly and said air guide in order to protect said motor assembly and said air guide, said rear casing being made of a plastic by using an injection molding process, said rear casing being engaged with the inner end of said front cap at an opening end thereof, said rear casing having a cylindrical shape, said rear casing including a second taper portion which is formed at the opening end of said rear casing, a second through hole which is formed through a closing end of said rear casing, and a plurality of second exhaust openings for exhausting air which is exhausted from said motor assembly, to the outside of said sound absorbing assembly, in which said second taper portion corresponds to said first taper portion, and said second exhaust openings are formed through a closing end of said rear casing; and (e) a rear cap for supporting a rear end of said motor assembly and for alleviating a vibration which is generated during the operation of said motor assembly, said rear cap being made of an anti-vibration rubber by using an injection molding process, said rear cap being engaged with the rear end of said motor assembly during the assembling of said sound absorbing assembly, and said rear cap being exposed to the outside of said sound absorbing assembly through said first through hole and said second through hole.

* * * * *